US012773755B2

(12) United States Patent
Duernegger et al.

(10) Patent No.: US 12,773,755 B2
(45) Date of Patent: Oct. 27, 2026

(54) GEAR HEAD AND HAND-HELD POWER TOOL

(71) Applicant: C. & E. Fein GmbH, Schwaebisch Gmuend-Bargau (DE)

(72) Inventors: Wolfgang Duernegger, Schorndorf (DE); Tobias Hokenmaier, Rechberghausen (DE)

(73) Assignee: C. & E. Fein GmbH, Schwaebisch Gmuend-Bargau (DE)

( * ) Notice: Subject to any disclaimer, the term of this patent is extended or adjusted under 35 U.S.C. 154(b) by 1671 days.

(21) Appl. No.: 16/942,435

(22) Filed: Jul. 29, 2020

(65) Prior Publication Data

US 2021/0031327 A1 Feb. 4, 2021

(30) Foreign Application Priority Data

Jul. 29, 2019 (DE) ..... 20 2019 104 156.0

(51) Int. Cl.

| | |
|---|---|
| ***B24B 23/02*** | (2006.01) |
| ***B24B 47/12*** | (2006.01) |
| ***B24B 55/05*** | (2006.01) |

(52) U.S. Cl.

CPC ..... *B24B 23/028* (2013.01); *B24B 47/12* (2013.01); *B24B 55/052* (2013.01)

(58) Field of Classification Search

CPC ..... B24B 23/028; B24B 47/12; B24B 55/052; B24B 23/02; B24B 23/022; B24B 41/002;

(Continued)

(56) References Cited

U.S. PATENT DOCUMENTS 6,918,127 B2 * 7/2005 Maeda ..... G11B 17/0515 720/620
7,524,239 B2 * 4/2009 Schmidberger-Brinek ..... B24B 55/052 451/454

(Continued)

FOREIGN PATENT DOCUMENTS

CN 207746863 U * 8/2018
DE 102007052683 A1 5/2009

(Continued)

OTHER PUBLICATIONS

Karlovic Publication Jun. 26, 2014 retrieved translation from Espacenet: https://worldwide.espacenet.com/patent/search/family/050878422/publication/DE102012112621A1?q=DE102012112621A1 (Year: 2014).*

(Continued)

*Primary Examiner* — Monica S Carter
*Assistant Examiner* — Christopher Soto
(74) *Attorney, Agent, or Firm* — Muncy, Geissler, Olds & Lowe, P.C.

(57) ABSTRACT

A gear head for a hand-held power tool for machining workpieces, in particular for an angle grinder. The gear head including a gear plate, a housing closable by the gear plate, in which a power take-off is accommodated, which is connectable to a drive of the hand-held power tool, the power take-off including a tool shaft protruding from the gear plate, which is at least partially surrounded by a safety guard fastenable to a gear flange of the housing. A securing lever locks the safety guard on the gear flange, the securing lever being adjustable around a pivot axis between a first position, in which the safety guard is rotatably fixedly connected to the gear flange and a second position, in which the safety guard is rotatable with respect to the gear flange (Continued)

against a force of a restoring element acting in a direction of the first position.

17 Claims, 6 Drawing Sheets

(58) Field of Classification Search
CPC ..... B24B 41/04; B24B 41/047; B24B 55/04; B25F 5/001; B25F 5/02
USPC ..... 451/344, 359, 451, 452, 454, 455
See application file for complete search history.

(56) References Cited

U.S. PATENT DOCUMENTS

2009/0156105 A1* 6/2009 Widmer ..... B24B 55/052 451/451
2013/0000935 A1* 1/2013 Kelleher ..... B23Q 11/08 173/46
2014/0370792 A1* 12/2014 Boeck ..... H01H 9/06 451/359
2016/0016285 A1 1/2016 Cooksey et al.

FOREIGN PATENT DOCUMENTS

DE 102008000732 A1 9/2009
DE 102012112621 A1 * 6/2014 ..... B24B 55/052
EP 1908549 A1 4/2008
JP 2014133295 A 7/2014

OTHER PUBLICATIONS

Le J Publication Aug. 21, 2018 retrieved translation from Google Patents: https://patents.google.com/patent/CN207746863U/en?oq=CN+207746863+U (Year: 2018).*

* cited by examiner

GEAR HEAD AND HAND-HELD POWER TOOL

This nonprovisional application claims priority under 35 U.S.C. § 119(a) to German Patent Application No. 20 2019 104 156.0, which was filed in Germany on Jul. 29, 2019, and which is herein incorporated by reference.

BACKGROUND OF THE INVENTION

Field of the Invention

The present invention relates to a gear head for a hand-held power tool for machining workpieces, in particular for an angle grinder, comprising a housing, closable by a gear plate, in which a power take-off is accommodated, which is connectable to a drive of a hand-held power tool, the power take-off including a tool shaft protruding from the gear plate, which is at least partially surrounded by a safety guard accommodated on a gear flange of the housing, also comprising a securing lever for locking the safety guard on the gear flange, which is supported on the gear plate, adjustable around a pivot axis from a first position, in which the safety guard is rotatably fixedly connected to the gear flange, and a second position, in which the safety guard is rotatably with respect to the gear flange, against the force of a restoring element acting in the direction of the first position. The invention also relates to a hand-held power tool comprising a gear head according to the invention.

Description of the Background Art

Gear heads have long been known from the prior art, in particular in angle grinders. To protect the user, it is required to use them only with a safety guard, which surrounds a part of the tool connected to the tool shaft and makes the grinding wheel accessible only within a certain angle range. This is intended to protect the user, in particular against particles which may arise during the machining of workpieces. To allow a preferably versatile use of the hand-held power tool equipped with the gear head, the safety guards are rotatably fastened to the gear flange, the safety guard being lockable by the securing level, i.e. its rotational position being fixable.

The securing lever must ensure that the safety guard and the securing lever also withstand the stresses which occur when a tool connected to the tool shaft breaks, for example a grinding wheel. The breaking tools pose an enormous risk of injury, due to the high rotational speeds, which must be mitigated by the safety guard. If the safety guard rotates an impermissible distance during the breaking of the tool, parts of the breaking tool may strike the user, which would be associated with serious injuries. The safety guard should therefore not, or only slightly, rotate during the breaking of the tool. The forces acting upon the safety guard and the securing lever during the breaking of the tool are so high that the securing lever is partially deformed, and there is the risk that the locking of the safety guard by the securing lever is released.

In the present case, the tool shaft is the part of the power take-off to which the tool is fastened. In angle grinders, this tool shaft is usually perpendicular to the motor longitudinal axis.

SUMMARY OF THE INVENTION

It is therefore an object of the present invention to reduce the aforementioned disadvantages and to provide an improved gear head. The object of the invention is also to provide an improved hand-held power tool.

The object relating to the gear head is achieved according to the invention in a gear head of the type mentioned at the outset in that a securing device limiting the adjustment of the securing lever beyond the first position is provided, which has a contact surface.

The forces occurring, in particular upon the breaking of a tool, are conducted by the contact surface of the securing device from the safety guard via the securing lever and the securing device into the gear plate and the gear head, which reduces the risk of a mechanical overload of the securing lever, which would result in a structural failure of the securing lever locking the safety guard.

It has also proven to be favorable if a gap, whose width is between 0.5 mm and 1.0 mm, is formed between the securing lever and the contact surface in the first position. The forces occurring upon the breaking of the tool are conducted hereby directly into the gear plate and thus into the gear head without a deformation of the securing lever first occurring. A replacement of the securing lever may thus be dispensed with after the tool breaks.

In addition, the adjustment of the securing lever from the first position into the second position is not disadvantageously influenced hereby. Within the scope of the invention, however, it is also provided that the securing lever abuts the contact surface in the first position.

It has also proven to be advantageous if the ratio between the length of the contact surface and the length of the securing lever is between 1:8 and 1:4. The occurring forces are thus particularly effectively conducted into the gear plate, and it is simultaneously ensured that the additional weight of the securing device does not negatively affect the handling of the hand-held power tool.

It has also proven to be successful if the contact surface is formed in the area of the pivot axis of the securing lever. This area has proven to be particularly vulnerable if, when a tool breaks, the breaking parts thereof strike and accelerate the safety guard. In this case, there is namely the risk that the securing lever is literally pulled into the intermediate space between the gear flange and the pivot axis. Therefore, if the contact surface is provided in this area, this risk is significantly reduced.

It has also proven to be favorable if the securing device having the contact surface has an essentially wedge-shaped cross section. An improved force absorption is also achieved hereby, which has a positive effect.

It has also proven to be particularly favorable if the securing device is formed as a single piece with the gear plate. A particularly high mechanical rigidity and load tolerance may be achieved hereby.

Within the scope of the invention, however, it is also provided that the securing device is detachably connected to the gear plate. This makes it possible to easily replace a damaged securing device. In this connection, it has also proven to be successful if the securing device is screwed to the gear plate. For this purpose, the securing device may have a screw eyelet, and a recess is advantageously provided in the gear plate, into which the securing device may be rotatably fixedly inserted.

It has furthermore proven to be advantageous if the securing device has an S-shaped design, with a first leg, which forms the contact surface, and with a second leg, which is accommodated in the gear plate. For example, a slot or a recess, with which the second leg may engage or on which it may be supported, may be formed in the gear plate to accommodate the second leg. For example, the screw eyelet may be disposed in the area formed perpendicularly to the legs.

Alternatively or additionally, it has also proven to be particularly favorable if the securing device has a securing engagement formed on the gear plate and a securing hook formed on the securing lever. One again, occurring forces may be easily absorbed hereby and prevent the securing lever from being deformed. The securing hook may also be positioned with respect to the securing engagement in such a way that these components come into engagement with each other only upon a slight deformation of the securing lever. In particular, a deflection of the securing lever in the direction of the pivot axis is prevented hereby. The securing engagement ultimately forms the contact surface of the securing device or at least a part thereof.

In this connection, it has also proven to be favorable if the securing hook is disposed in the area of the end of the securing lever facing away from the pivot axis. In addition to an improved force transmission, this has, in particular, a positive effect on the assembly complexity.

It has further proven to be successful if the pivot axis is oriented in parallel to the tool shaft. This allows the securing lever to be particularly easily gripped by the user, which has a positive effect on the user-friendliness of a hand-held power tool equipped with the gear head according to the invention. Within the scope of the invention, the pivot axis may, however, also be oriented perpendicularly to the tool shaft.

The object relating to the hand-held power tool is also achieved according to the invention by a hand-held power tool comprising a gear head according to the invention.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
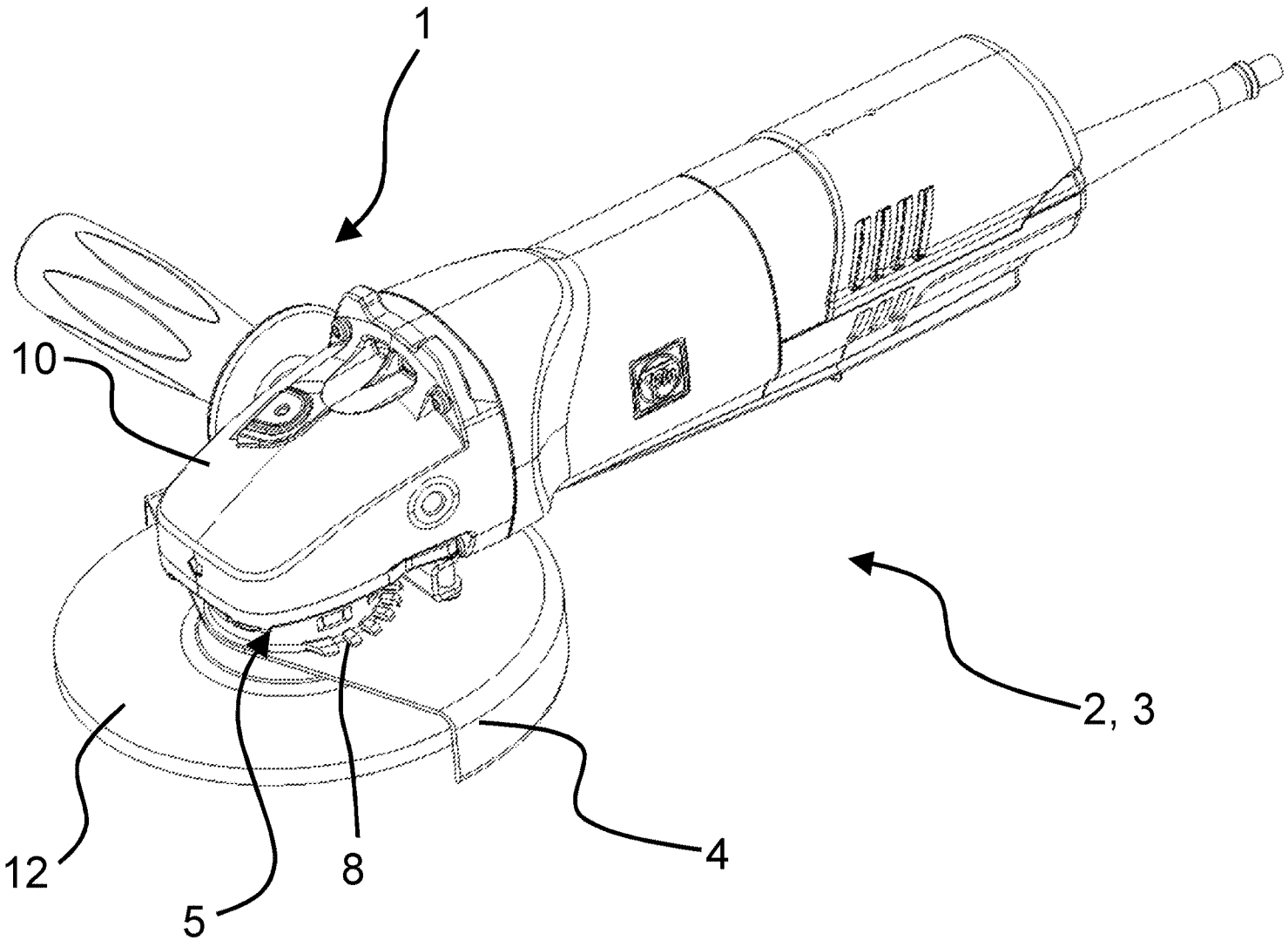
FIG. 1 shows a perspective view of a hand-held power tool.
Figure 4:
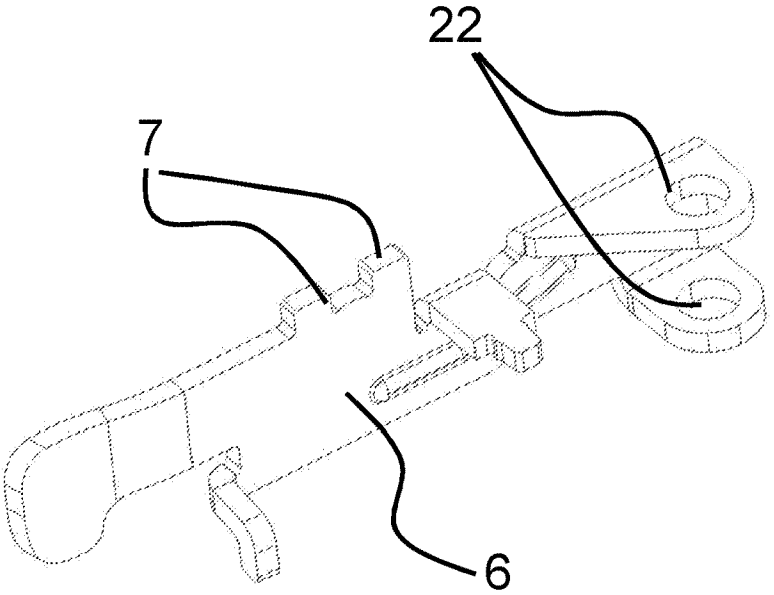
FIG. 4 shows a perspective view of a securing lever.
Figure 6:
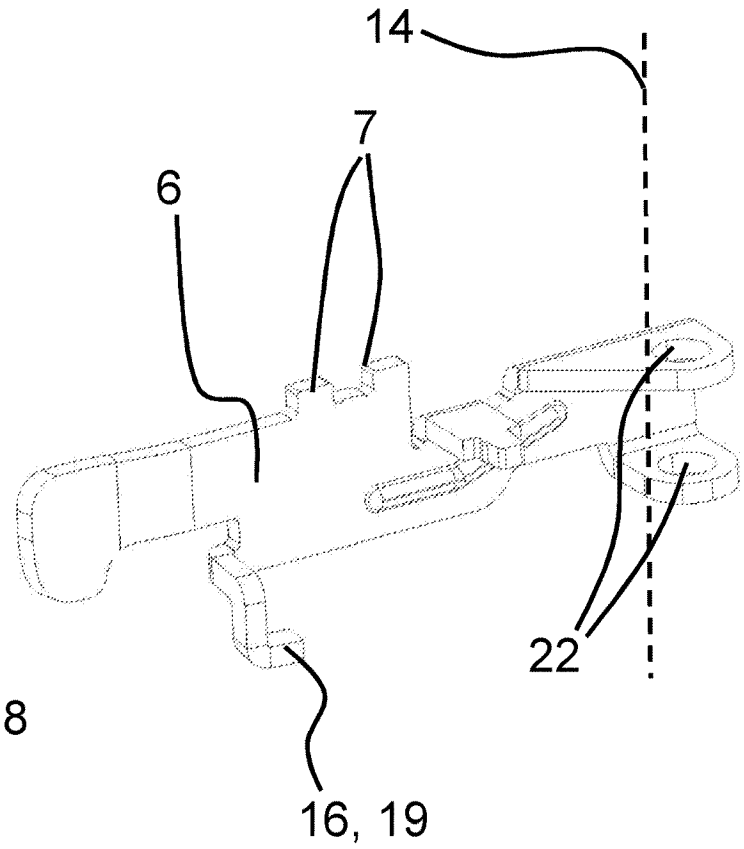
FIG. 6 shows a perspective view of a securing lever.

FIG. 1 shows a perspective view of a gear head 1, which is assigned to a hand-held power tool 2 for machining workpieces, which is formed, in the exemplary embodiment, as an angle grinder 3. It is also apparent from FIG. 1 that a safety guard 4 is fastened to gear head 1, whose rotational position on a gear flange 5 is lockable with the aid of a securing lever 6. As is further apparent, in particular, from FIGS. 4 and 6, securing lever 6 has two latching tabs 7, which engage with recesses 8, which are formed on safety guard 4.

Figure 2:
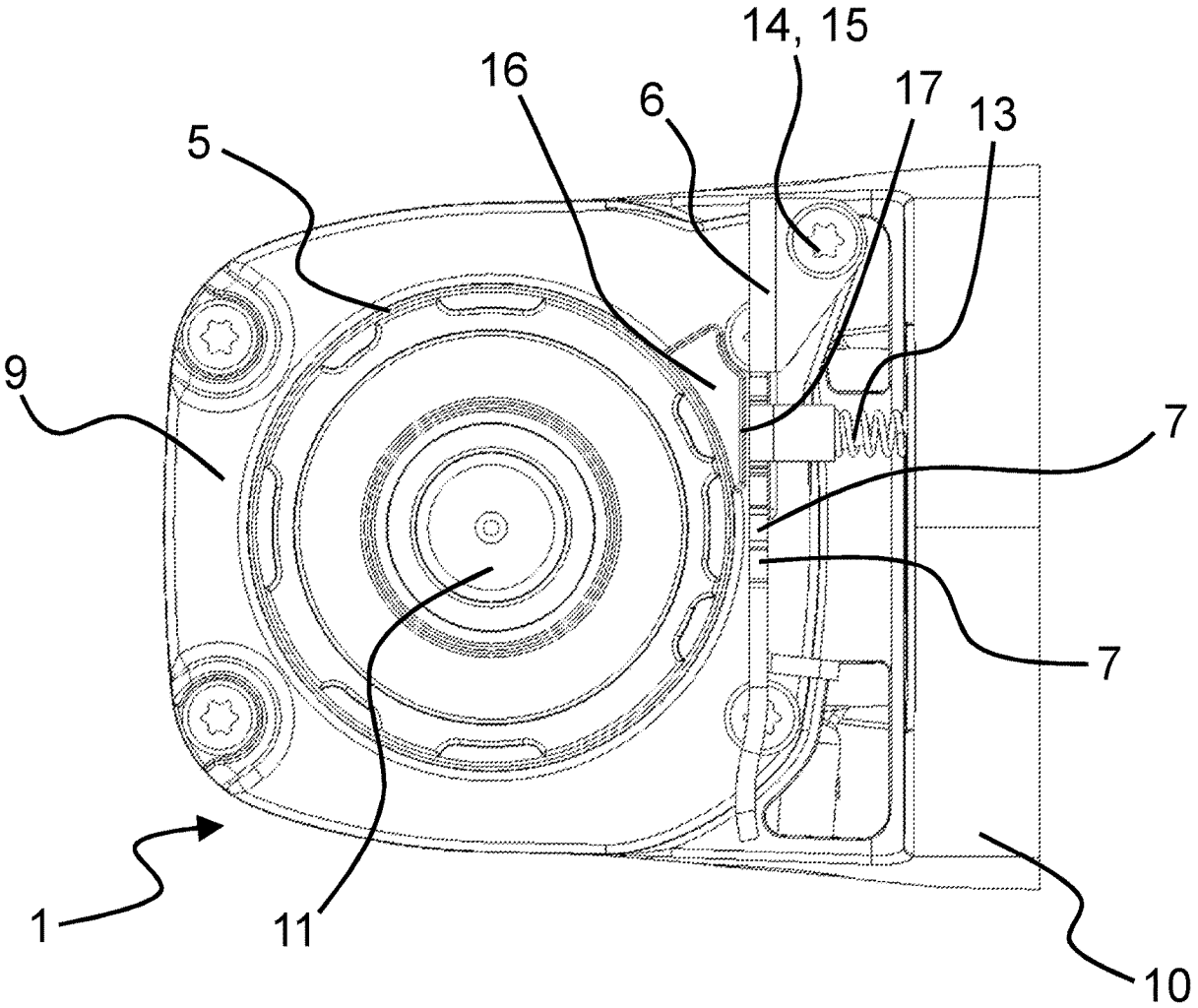
FIG. 2 shows a top view from below of an exemplary embodiment of a gear head according to the invention.

FIG. 2 shows a top view from below of gear head 1, which comprises a housing 10, closable by a gear plate 9, in which a power take-off is accommodated. This power take-off, in turn, is connected to a drive of hand-held power tool 2 and comprises a tool shaft 11 protruding from gear plate 9, on which a tool 12 may be fastened, as is apparent from FIG. 1. Securing lever 6 is provided on gear flange 5 to secure safety guard 4, which is not illustrated for the sake of clarity. Securing lever 6 is supported on gear plate 9, adjustable around a pivot axis 14 between a first position, in which safety guard 4 is rotatably fixedly connected to gear flange 5, and a second position, in which safety guard 4 is rotatable with respect to gear flange 5, against the force of a restoring element 13 acting in the direction of the first position. In the view illustrated in FIG. 2, pivot axis 14 is oriented collinearly with the longitudinal axis of screw 15 and thus in parallel to tool shaft 11. To prevent an adjustment of securing lever 6 beyond first position in the first position of securing lever 6, which would be associated with a mechanical deformation thereof, a securing device 16 is provided, which has a contact surface 17, with which securing lever 6 comes into contact if it is adjusted beyond the first position.

Figure 3:
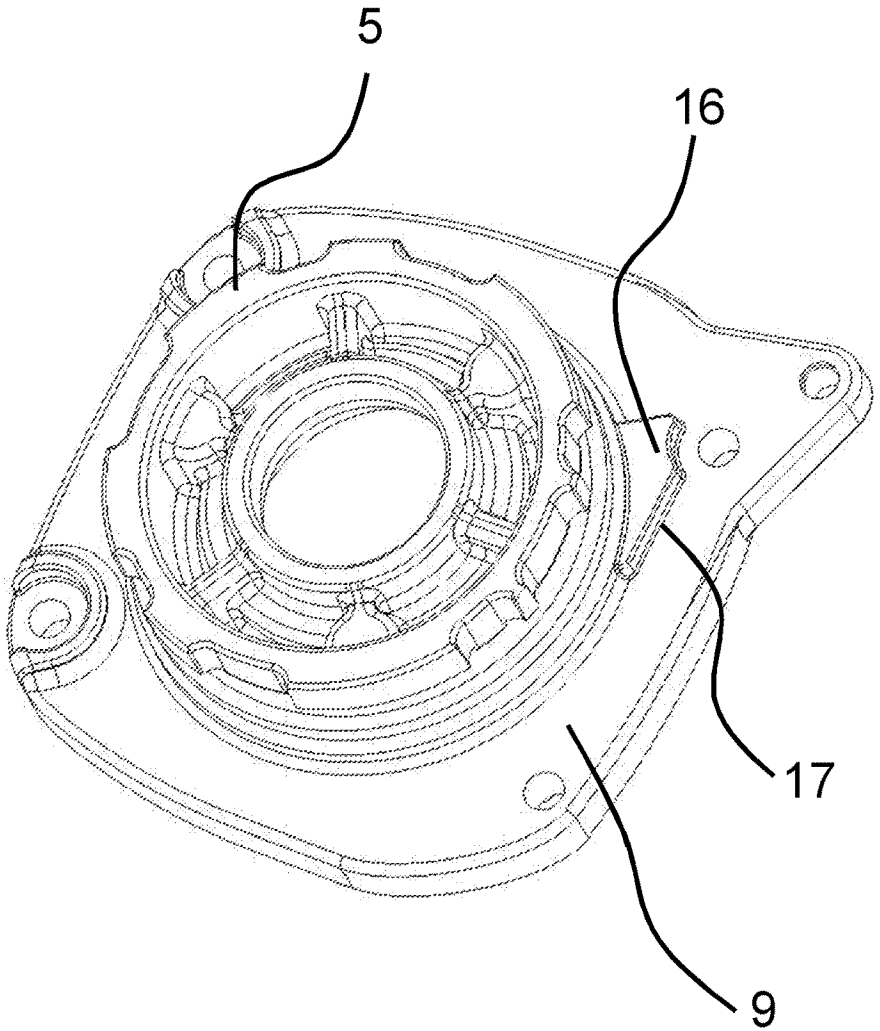
FIG. 3 shows a perspective view of a gear plate.

As is apparent, in particular in the view illustrated in FIG. 3 of gear plate 9 in the first specific embodiment of gear head 1 according to the invention, this securing device 16 is formed as a single piece with gear plate 9 and has an essentially wedge-shaped cross section. Contact surface 17 is formed in the area of pivot axis 14 of securing lever 6. In the illustrated exemplary embodiment, the ratio between the length of contact surface 17 and the length of securing lever 6 is between 1:8 and 1:4, namely approximately 1:6. A receptacle 22 for the screw defining pivot axis 14 as well as latching tabs 7, with the aid of which the rotational position of safety guard 4 may be fixed on gear flange 5, are apparent from FIG. 4, which shows securing lever 6.

Figure 5:
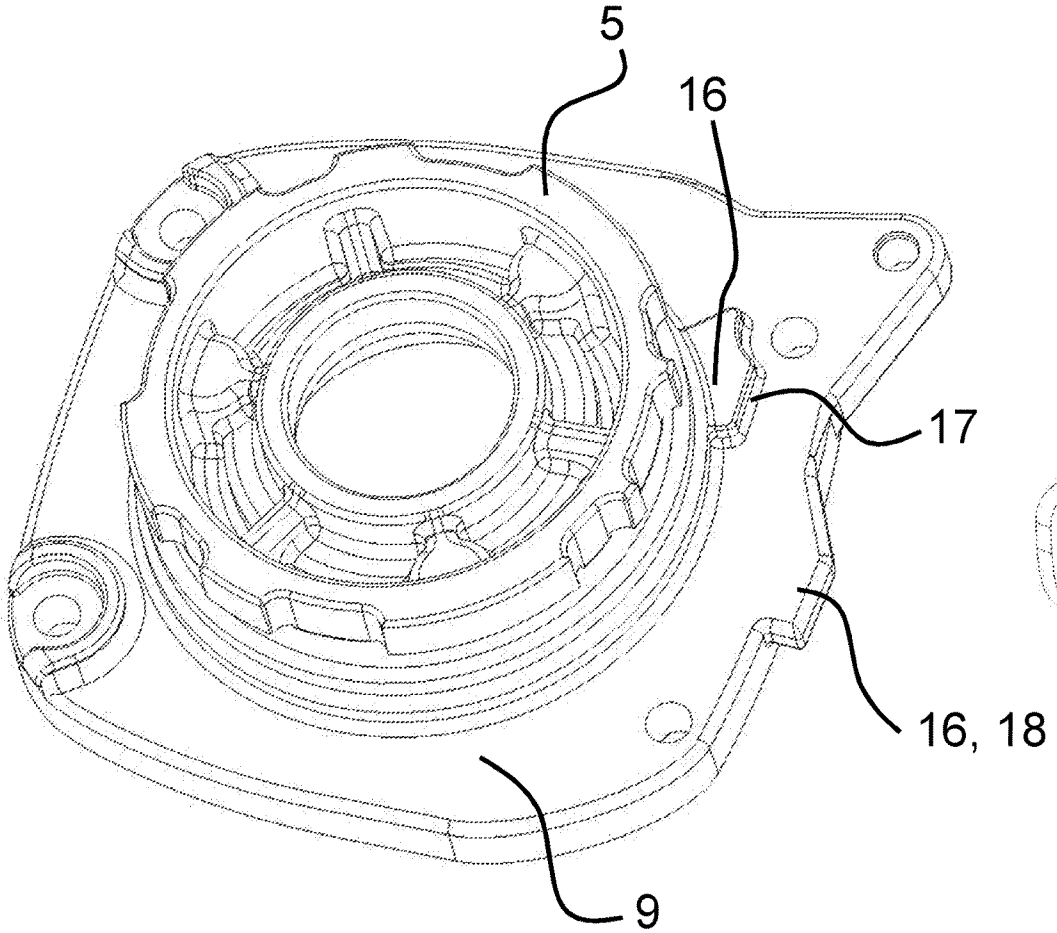
FIG. 5 shows a perspective view of the gear plate of an exemplary embodiment of the gear head according to the invention.

FIG. 5 shows a gear plate 9 in a second specific embodiment of gear head 1 according to the invention. In this specific embodiment, contact surface 17 is shorter than in the first specific embodiment according to FIG. 3, while a securing engagement 18 is additionally formed on gear plate 9, with which a securing hook 19 engages, which is apparent, in particular, from FIG. 6 and which is situated in the area of the end of securing lever 6 facing away from pivot axis 14, if securing lever 6 is adjusted beyond the first position. Securing engagement 18 and securing hook 19 are ultimately part of securing device 16 in this specific embodiment. It would also be possible to form securing device 16 exclusively from securing engagement 18 and securing hook 19 and to dispense with a contact surface 17.

Figure 7:
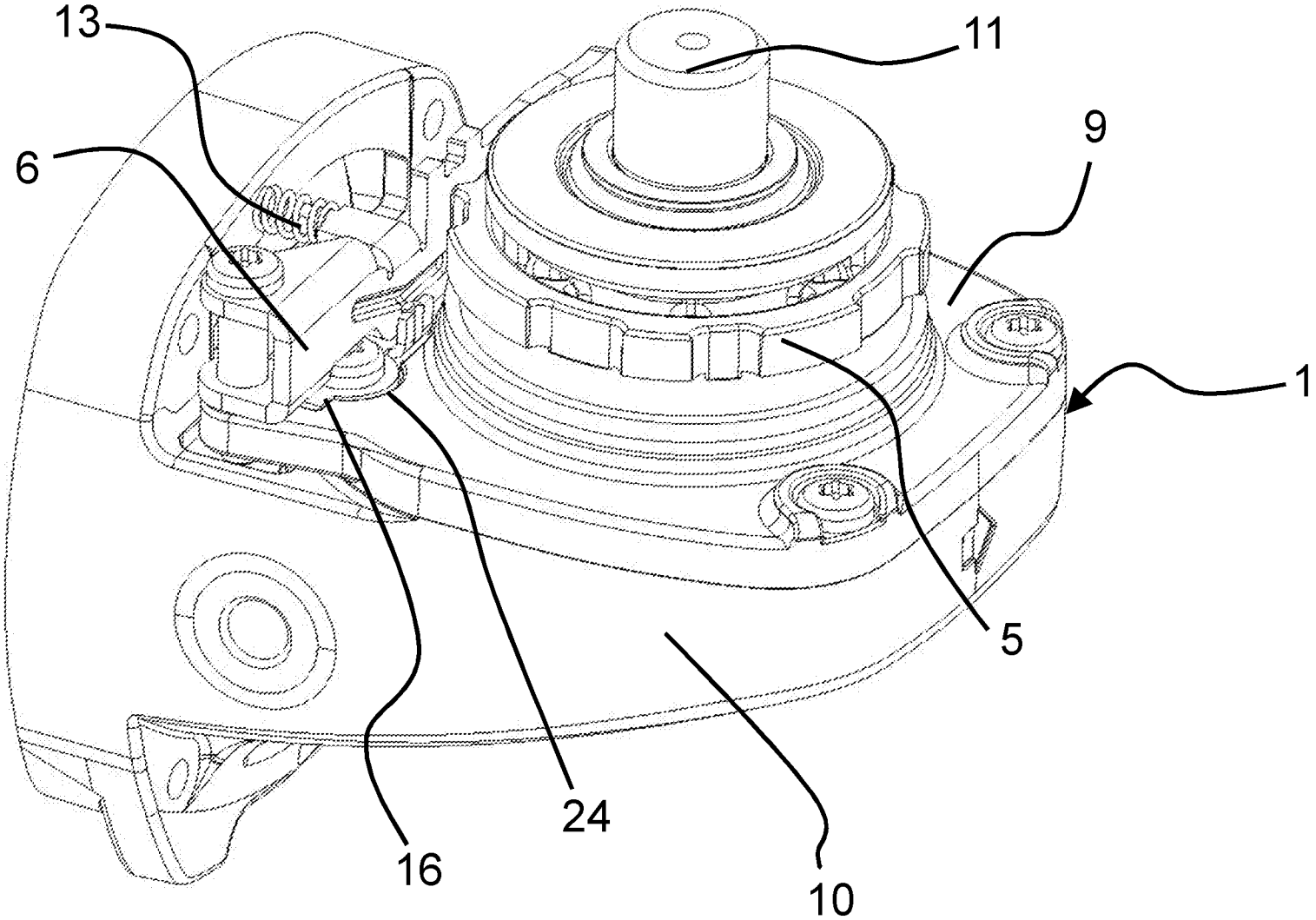
FIG. 7 shows a perspective view of an exemplary embodiment of the gear head according to the invention.
Figure 9:
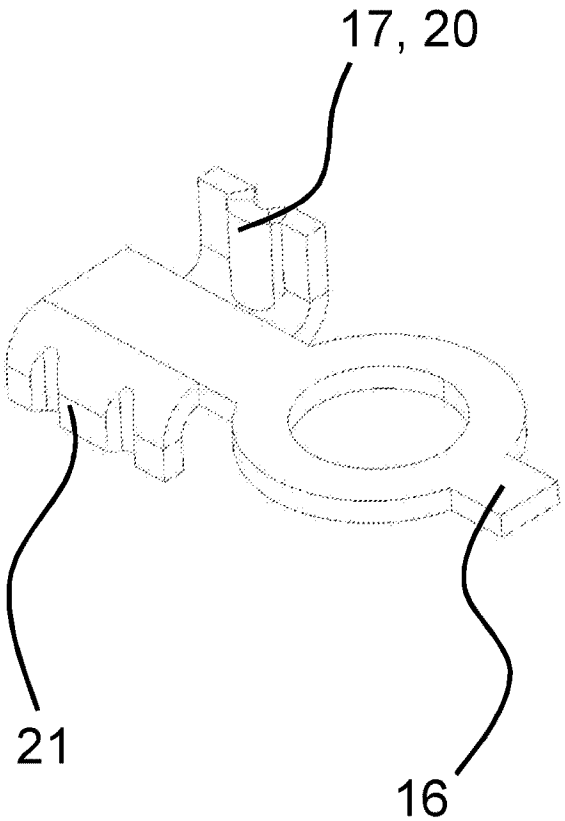
FIG. 9 shows a securing component of the gear head.
Figure 8:
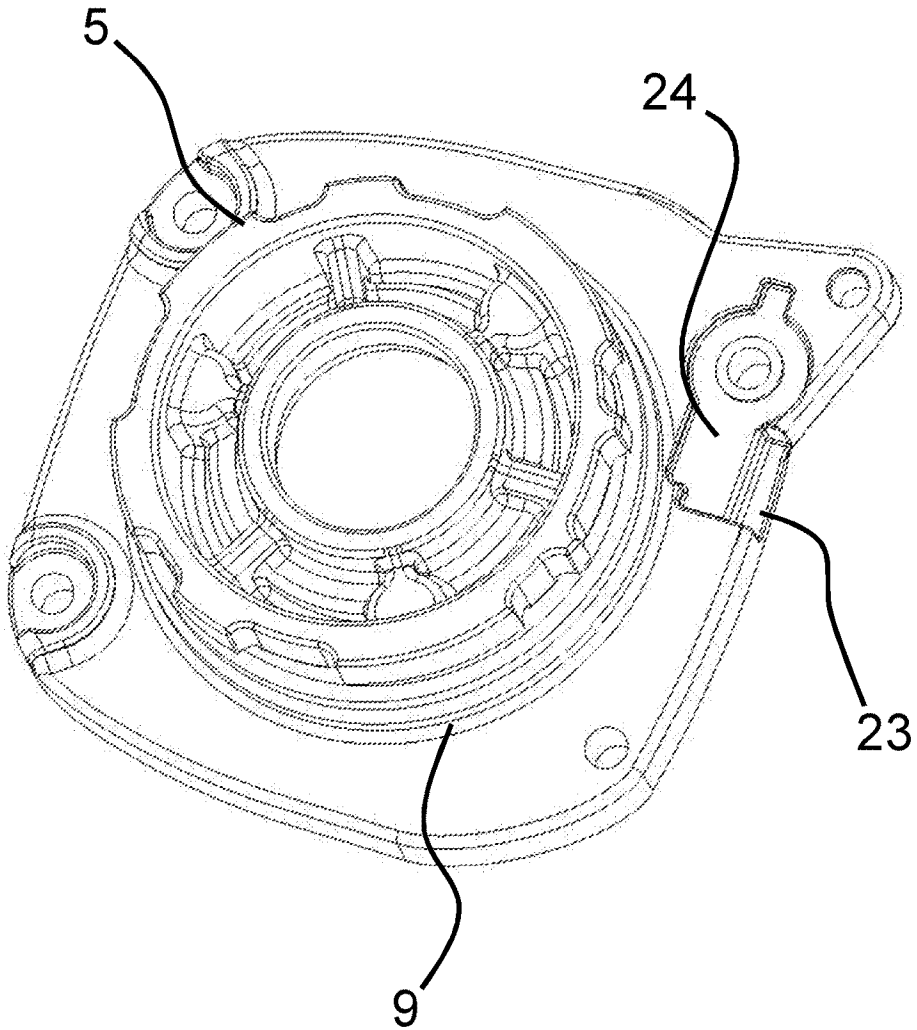
FIG. 8 shows a perspective view of a gear plate.

In the third exemplary embodiment of gear head 1 illustrated in FIG. 7, securing device 16 is screwed to gear plate 9. For this purpose—as is apparent from FIG. 8—an indentation 24, which at least partially represents a negative shape of securing device 16, is worked into gear plate 9. It has an S-shaped design with a first leg 20, which forms contact surface 17, and with a second leg 21, which is accommodated in a recess 23 formed in gear plate 9. First leg 20 and second leg 21 are each oriented perpendicularly to gear plate 9, and the area between the two legs 20, 21 rests in indentation 24 in gear plate 9.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A gear head for a hand-held power tool for machining workpieces, the gear head comprising:

a gear plate;

a housing closable by the gear plate, in which a power take-off is accommodated, which is connectable to a drive of the hand-held power tool, the power take-off including a tool shaft protruding from the gear plate, which is at least partially surrounded by a safety guard fastenable to a gear flange of the housing;

a securing lever that locks the safety guard on the gear flange, which is supported on the gear plate, the securing lever being adjustable around a pivot axis between a first position, in which the safety guard is rotatably fixed and connected to the gear flange and a second position, in which the safety guard is rotatable with respect to the gear flange against a force of a restoring element acting in a direction of the first position; and a securing device that limits an adjustment of the securing lever beyond the first position, the securing device having a contact surface, wherein a ratio between a length of the contact surface and a length of the securing lever is between 1:8 and 1:4.

2. The gear head according to claim 1, wherein a gap, whose width is between 0.5 mm and 1.0 mm, is formed between the securing lever and the contact surface in the first position.

3. The gear head according to claim 1, wherein the contact surface is formed in an area of the pivot axis.

4. The gear head according to claim 1, wherein the securing device having the contact surface has an essentially wedge-shaped cross section.

5. The gear head according to claim 1, wherein the securing device is formed as a single piece with the gear plate.

6. The gear head according to claim 1, wherein the securing device is detachably connected to the gear plate.

7. The gear head according to claim 6, wherein the securing device is screwed to the gear plate.

8. The gear head according to claim 6, wherein the securing device has an S-shaped design with a first leg, which forms the contact surface and with a second leg, which is accommodated in the gear plate.

9. The gear head according to claim 1, wherein the securing device has a securing engagement formed on the gear plate and a securing hook formed on the securing lever.

10. The gear head according to claim 9, wherein the securing hook is disposed in an area of the end of the securing lever facing away from the pivot axis.

11. The gear head according to claim 1, wherein the pivot axis is oriented in parallel to the tool shaft.

12. The gear head according to claim 1, wherein the hand-held power tool is an angle grinder.

13. The handheld power tool according to claim 1, wherein the pivot axis is offset from a rotation axis of the tool shaft.

14. The handheld power tool according to claim 1, wherein the securing lever is separate from the securing device, such that the securing device remains stationary during rotation of the securing lever.

15. The gear head according to claim 1, wherein the restoring element is a spring.

16. A handheld power tool comprising:

a drive; and a gear head, the gear head comprising:

a gear plate;

a housing closable by the gear plate, in which a power take-off is accommodated, which is connectable to the drive, the power take-off including a tool shaft protruding from the gear plate, which is at least partially surrounded by a safety guard fastenable to a gear flange of the housing;

a securing lever that locks the safety guard on the gear flange, which is supported on the gear plate, the securing lever being rotatable around a pivot axis between a first position, in which the safety guard is rotatably fixed and connected to the gear flange and a second position, in which the safety guard is rotatable with respect to the gear flange against a force of a restoring element acting in a direction of the first position; and a securing device that limits an adjustment of the securing lever beyond the first position, the securing device having a contact surface, wherein a ratio between a length of the contact surface and a length of the securing lever is between 1:8 and 1:4.

17. The handheld power tool according to claim 16, wherein the handheld power tool is an angle grinder.

* * * * *